US007509066B2

(12) United States Patent
Koshida

(10) Patent No.: US 7,509,066 B2
(45) Date of Patent: Mar. 24, 2009

(54) IMAGE FORMING APPARATUS WITH LOOP DETECTION AND CONVEYING SPEED CONTROL BASED THEREON

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 11/769,200

(22) Filed: Jun. 27, 2007

(65) Prior Publication Data

US 2007/0264038 A1 Nov. 15, 2007

Related U.S. Application Data

(62) Division of application No. 11/202,228, filed on Aug. 12, 2005, now Pat. No. 7,251,426.

(30) Foreign Application Priority Data

Sep. 6, 2004 (JP) ..... 2004-258854

(51) Int. Cl.
*G03G 15/20* (2006.01)
*G03G 15/00* (2006.01)

(52) U.S. Cl. ..... 399/68; 399/16; 399/397

(58) Field of Classification Search ..... 399/68, 399/67, 16, 320, 397, 400; 219/216; 271/265.1, 271/270

See application file for complete search history.

(56) References Cited

U.S. PATENT DOCUMENTS

| | | | | |
|---|---|---|---|---|
| 5,215,300 | A | 6/1993 | Hiroi et al. | 271/176 |
| 5,316,287 | A | 5/1994 | Hiroi et al. | 271/213 |
| 5,350,169 | A | 9/1994 | Hiroi et al. | 271/213 |
| 5,535,012 | A | 7/1996 | Matsumoto et al. | 399/397 X |
| 5,694,638 | A | 12/1997 | Maruyama et al. | 399/397 X |
| 6,564,025 | B2 | 5/2003 | Sameshima et al. | 399/68 |
| 7,251,426 | B2 * | 7/2007 | Koshida | 399/68 |
| 2002/0067927 | A1 * | 6/2002 | Matsunai | 399/68 |

(Continued)

FOREIGN PATENT DOCUMENTS

| | | |
|---|---|---|
| JP | 61-211255 | 9/1986 |

(Continued)

OTHER PUBLICATIONS

Official Letter/Search Report issued on Nov. 9, 2007, by the Chinese Patent Office, in Chinese Patent Application No. 2005100985911, and translation thereof.

*Primary Examiner*—Sophia S Chen
(74) *Attorney, Agent, or Firm*—Fitzpatrick, Cella, Harper & Scinto

(57) ABSTRACT

An image forming apparatus has transfer rollers for transferring an unfixed image, fixing rollers with a changeable conveying speed, discharging rollers with a changeable conveying speed thereof and for discharging the recording material on which the image has been fixed by the pair of fixing rollers, a loop detecting sensor for detecting the loop of the recording material between the transfer rollers and the fixing rollers, and a control for changing the conveying speed of the fixing rollers on the basis of the detection of the loop detecting sensor so that the loop of the recording material is maintained with a predetermined range, wherein the control board controls the conveying speed of the discharging rollers so as to become equal to the conveying speed of the fixing rollers after the recording material has passed the transfer rollers.

4 Claims, 11 Drawing Sheets

U.S. PATENT DOCUMENTS

| | | | | |
|---|---|---|---|---|
| 2002/0081121 | A1 | 6/2002 | Kamijo et al. | 399/68 |
| 2002/0141774 | A1 | 10/2002 | Nagano | 399/68 |
| 2003/0057632 | A1* | 3/2003 | Nishimura et al. | 271/69 |
| 2005/0158066 | A1* | 7/2005 | Tomiyori et al. | 399/68 |
| 2006/0051116 | A1 | 3/2006 | Koshida | 399/68 |
| 2007/0009271 | A1 | 1/2007 | Tanonaka | 399/68 X |

FOREIGN PATENT DOCUMENTS

| | | |
|---|---|---|
| JP | 5-107966 | 4/1993 |
| JP | 7-234604 | 9/1995 |
| JP | 8-146683 | 6/1996 |
| JP | 10-171290 | 6/1998 |
| JP | 2002-167094 | 6/2002 |
| JP | 2003-316184 | 11/2003 |

* cited by examiner

IMAGE FORMING APPARATUS WITH LOOP DETECTION AND CONVEYING SPEED CONTROL BASED THEREON

This application is a divisional of U.S. patent application Ser. No. 11/202,228, filed on Aug. 12, 2005, allowed May 27, 2007.

BACKGROUND OF THE INVENTION

1. Field of the Invention

The invention relates to an image forming apparatus in which an unfixed image is transferred to a recording material by transferring means, the unfixed image is fixed on the recording material by fixing means, and the recording material on which the image has been fixed is discharged by discharging means.

2. Related Background Art

Heretofore, in an image forming apparatus of an electrophotographic type, as shown in FIG. 10 of the accompanying drawings, an unfixed image borne on an intermediate transfer belt 102 has been transferred to a recording material P by a pair of transfer rollers 103, the unfixed image has been fixed on the recording material P by a pair of fixing rollers 105, and the recording material P on which the image has been fixed has been discharged to a discharging tray 107 outside the apparatus by a pair of discharging rollers 111.

In some cases, the pair of fixing rollers 105 suffer from a difference between the recording material conveying speed of the pair of fixing rollers 105 and the recording material conveying speed of the pair of transfer rollers 103 caused by the thermal expansion and the individual difference between the rollers or a variation in the rollers with the lapse of time. If at this time, the recording material conveying speed of the pair of fixing rollers 105 is higher than the recording material conveying speed of the pair of transfer rollers 103, the recording material P may be pulled between the pair of fixing rollers 105 and the pair of transfer rollers 103, and the disturbance or the like of the image may occur during the transfer of the image to the recording material P by the pair of transfer rollers 103, thus resulting the deterioration of the image. On the other hand, if the recording material conveying speed of the pair of fixing rollers 105 is lower than the recording material conveying speed of the pair of transfer rollers 103, the recording material P may form an excessively large loop between the pair of fixing rollers 105 and the pair of transfer rollers 103, whereby the recording material P may be strongly forced and rubbed against a conveying guide 120, and a fault image may occur.

Therefore, there has heretofore been made the following proposition which forms a predetermined loop in the recording material P between the pair of transfer rollers 103 and the pair of fixing rollers 105 to thereby prevent the recording material P from being pulled or too much flexed, and solve the deterioration of the image as mentioned above.

In Japanese Patent Application Laid-open No. H05-107966 and Japanese Patent Application Laid-open No. H07-234604, as shown in FIG. 10, a loop detecting sensor S for detecting the loop of the recording material P is provided in the conveying guide 120 portion between the pairs of fixing rollers 105 and the pair of transfer rollers 103, and in accordance with the result of this detection, the recording material conveying speed of the pair of fixing rollers 105 is changed over to a first speed lower than the recording material conveying speed of the pair of transfer rollers 103, or a second speed higher than the first speed so that a predetermined loop may be maintained.

However, in the case of the conventional art described in the above-mentioned Japanese Patent Application Laid-open No. H05-107966 and Japanese Patent Application Laid-open No. H07-234604, there is such a problem as shown below.

As shown in FIG. 10, during the time when the recording material P is being nipped and conveyed by the pair of transfer rollers 103, and the pair of fixing rollers 105, image formation can be effected while the loop of the recording material P is kept by the speed difference between the two pairs of rollers 103 and 105 based on the result of the detection by the loop detecting sensor S. However, when the trailing edge of the recording material P leaves the pair of transfer rollers 103, the loop of the recording material P is released as shown in FIGS. 11 and 12 of the accompanying drawings and therefore, the loop detecting sensor S becomes incapable of detecting the loop of the recording material P, and the actual recording material conveying speed of the pair of fixing rollers 105 for keeping the loop constant becomes undetectable. Therefore, the pair of fixing rollers 105 have nothing to do but conveying the recording material at the predetermined first speed or the second speed higher than that, and assuming that the conveying speed of the pair of discharging rollers 111 on the downstream side is equal to the conveying speed of the pair of transfer rollers 103, when the conveying speed of the pair of fixing rollers 105 was the second speed, the recording material P might become slack between the pair of fixing rollers 105 and the pair of discharging rollers 111, as shown in FIG. 11, and be rubbed against a conveying guide 122, thus resulting in a fault image. On the other hand, when the conveying speed of the pair of fixing rollers 105 was the first speed, the recording material P might become pulled between the pair of fixing rollers 105 and the pair of discharging rollers 111 and the curl of the recording material might become excessive, thus resulting in jam or fault stacking.

SUMMARY OF THE INVENTION

It is the object of the present invention to provide an image forming apparatus having loop detecting means between transferring means and fixing means which is free of the occurrence of a faulting image and excessive curl caused by the conveyed state of a recording material after the trailing edge of the recording material has left the transferring means, i.e., the loop state of the recording material between the fixing means and discharging means.

The image forming apparatus of the present invention for achieving the above object is provided with transferring means for transferring an unfixed image borne on an image bearing member to a recording material, fixing means changeable in the recording material conveying speed thereof and for fixing the transferred unfixed image on the recording material, discharging means changeable in the recording material conveying speed thereof and for discharging the recording material on which the image has been fixed by the fixing means, loop detecting means for detecting the loop state of the recording material between the transferring means and the fixing means, and controlling means for changing over the recording material conveying speed of the fixing means on the basis of a detection of the loop detecting means and controlling the loop of the recording material so as to be maintained within a predetermined range, and is characterized in that the controlling means controls the recording material conveying speed of the discharging means so as to become equal to the recording material conveying speed of the fixing means after the recording material has passed the transferring means.

DESCRIPTION OF THE PREFERRED EMBODIMENTS

Figure 1:
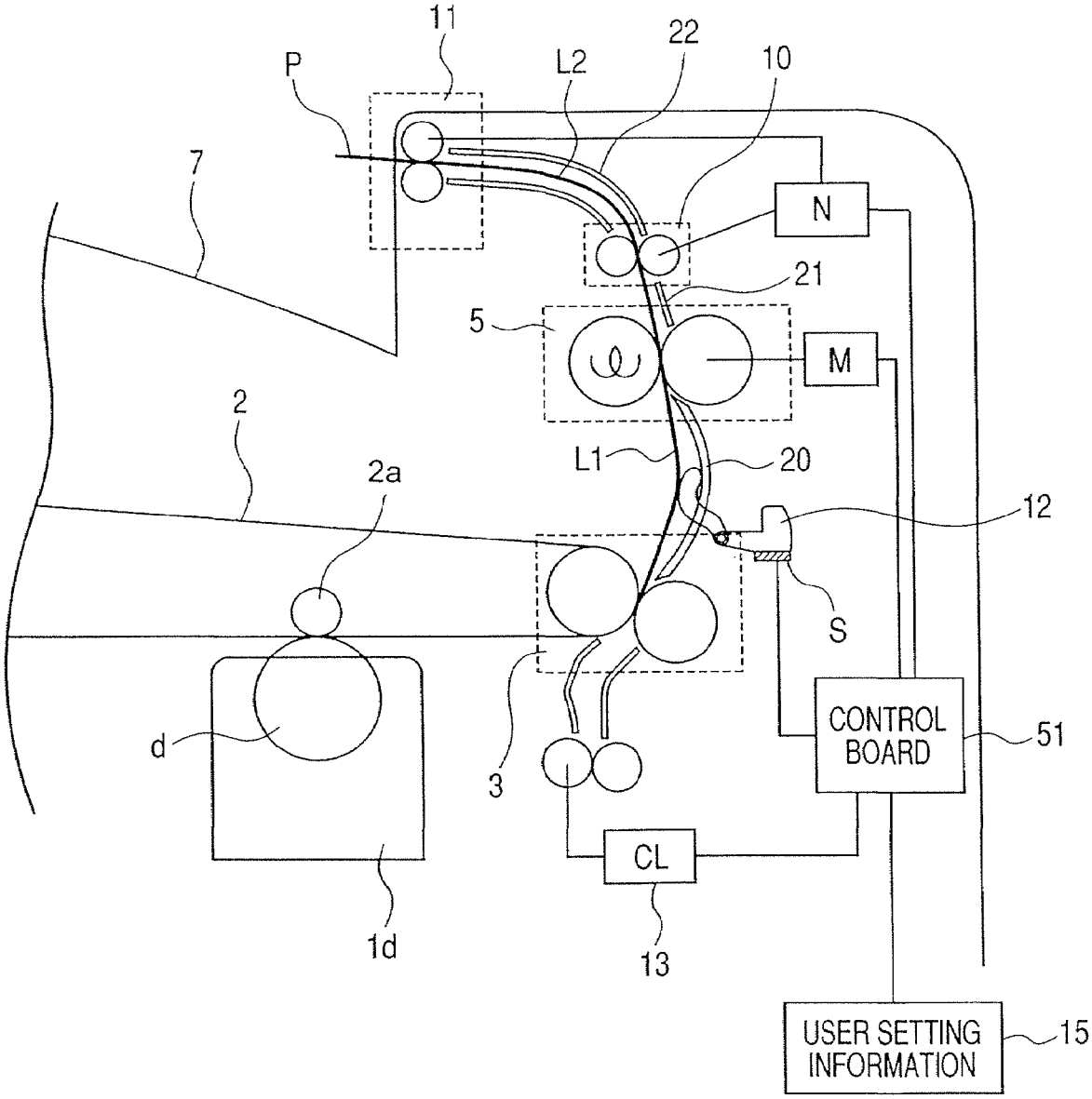
FIG. 1 is a cross-sectional view of the essential portions of an image forming apparatus according to an embodiment of the present invention.
Figure 2:
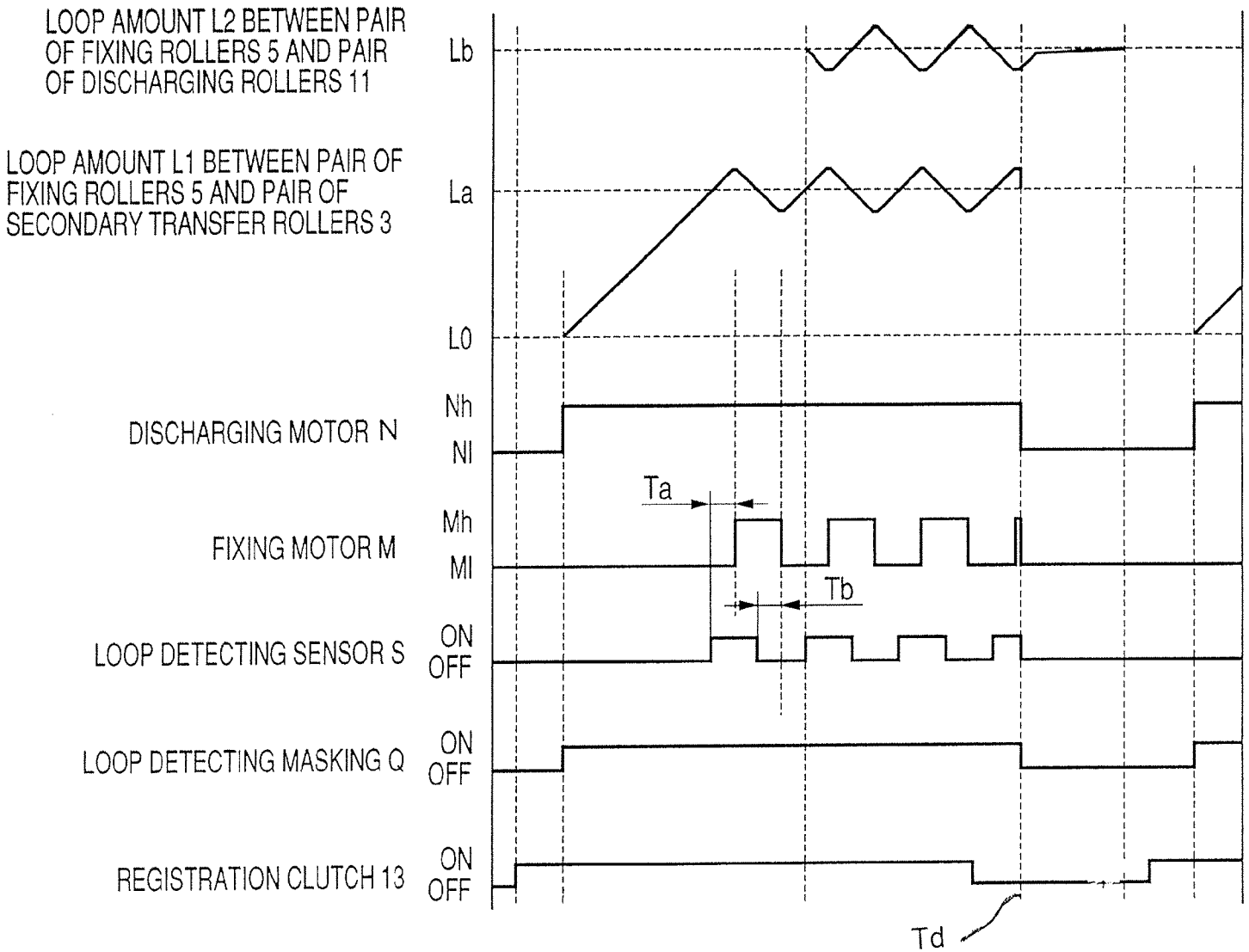
FIG. 2 is a time chart showing the control of the image forming apparatus according to the embodiment of the present invention.
Figure 3:
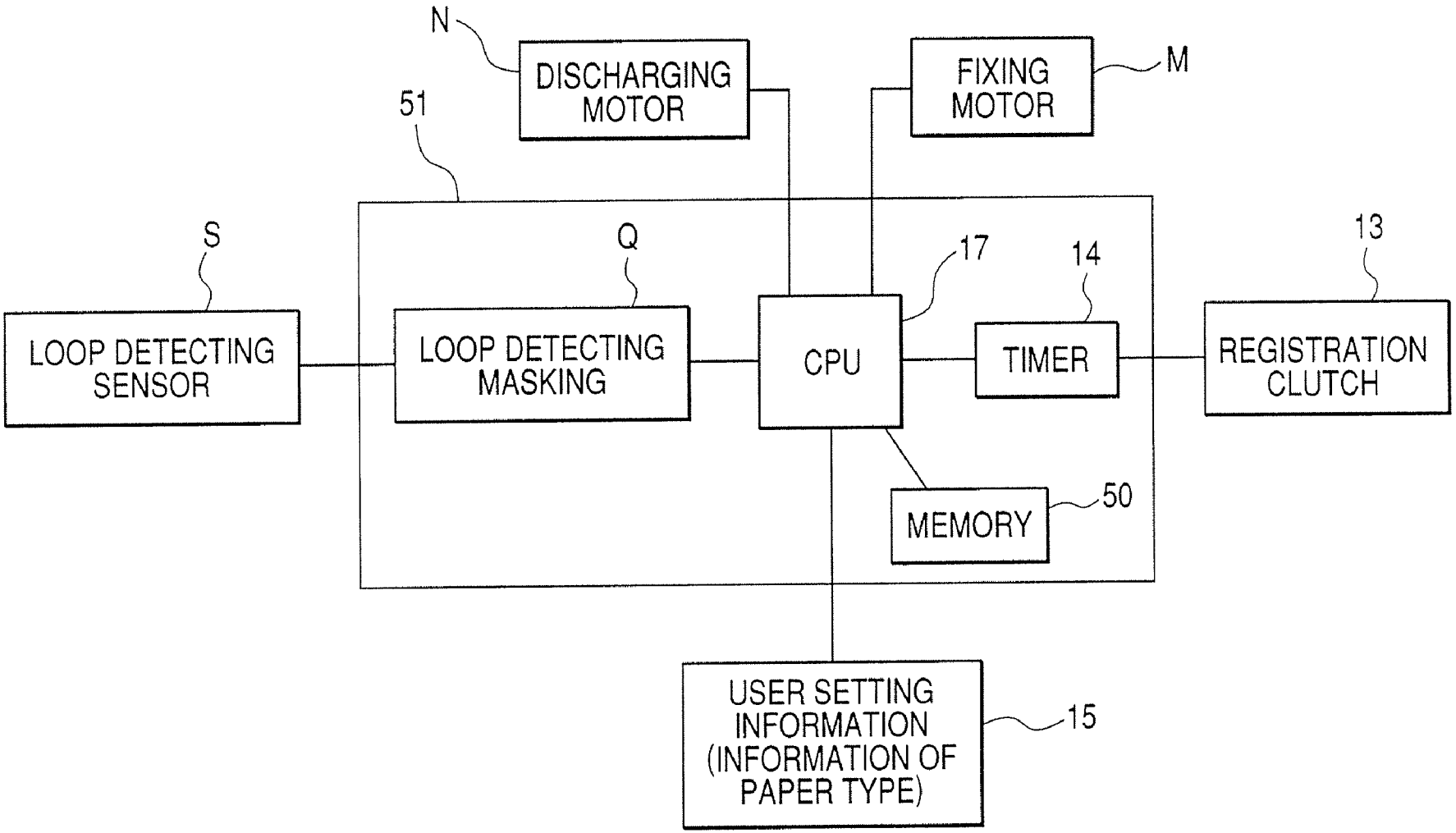
FIG. 3 is a block diagram showing the control system of the image forming apparatus according to the embodiment of the present invention.
Figure 9:
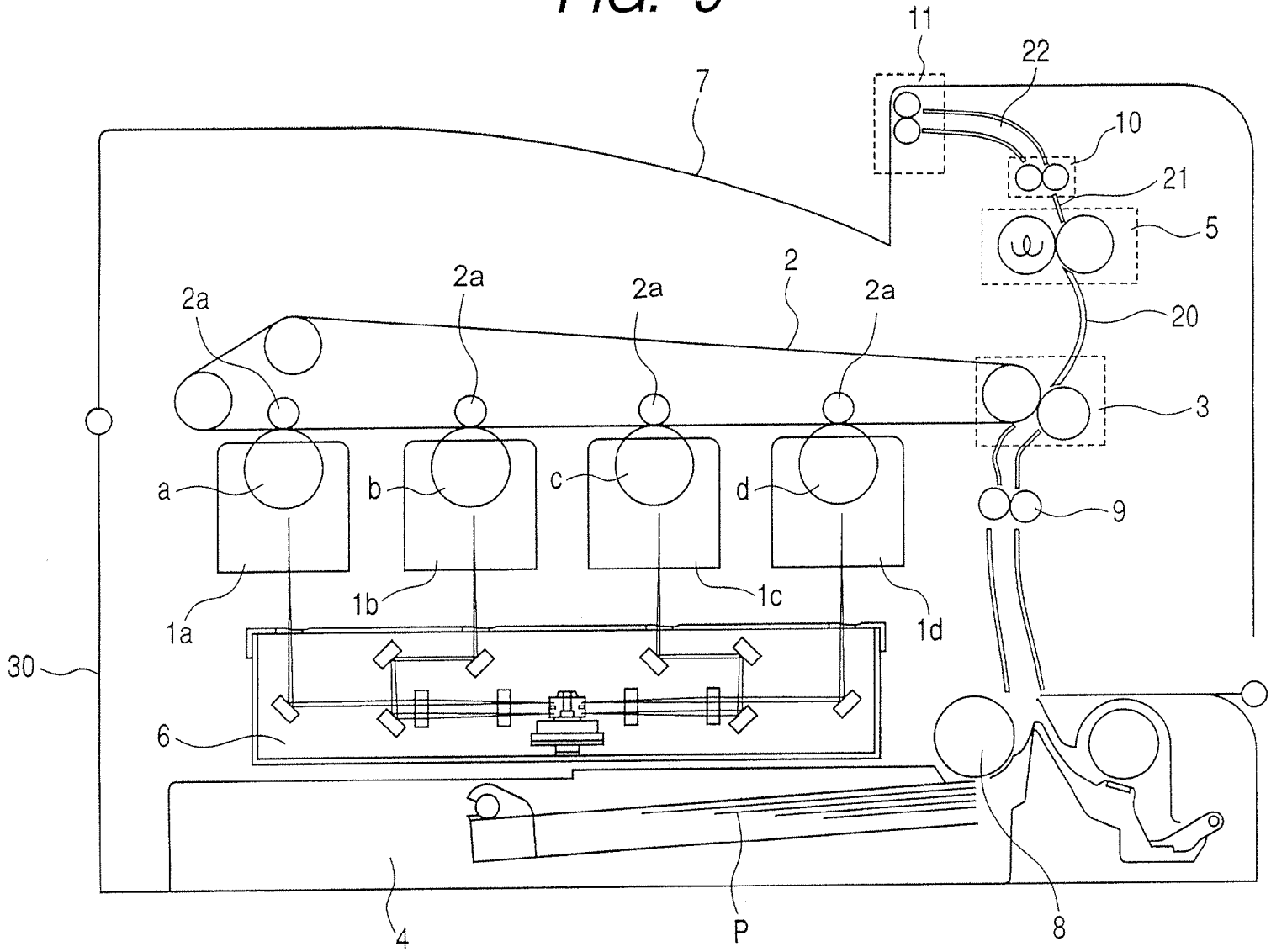
FIG. 9 is a cross-sectional view of the image forming apparatus according to the embodiment of the present invention.
Figure 10:
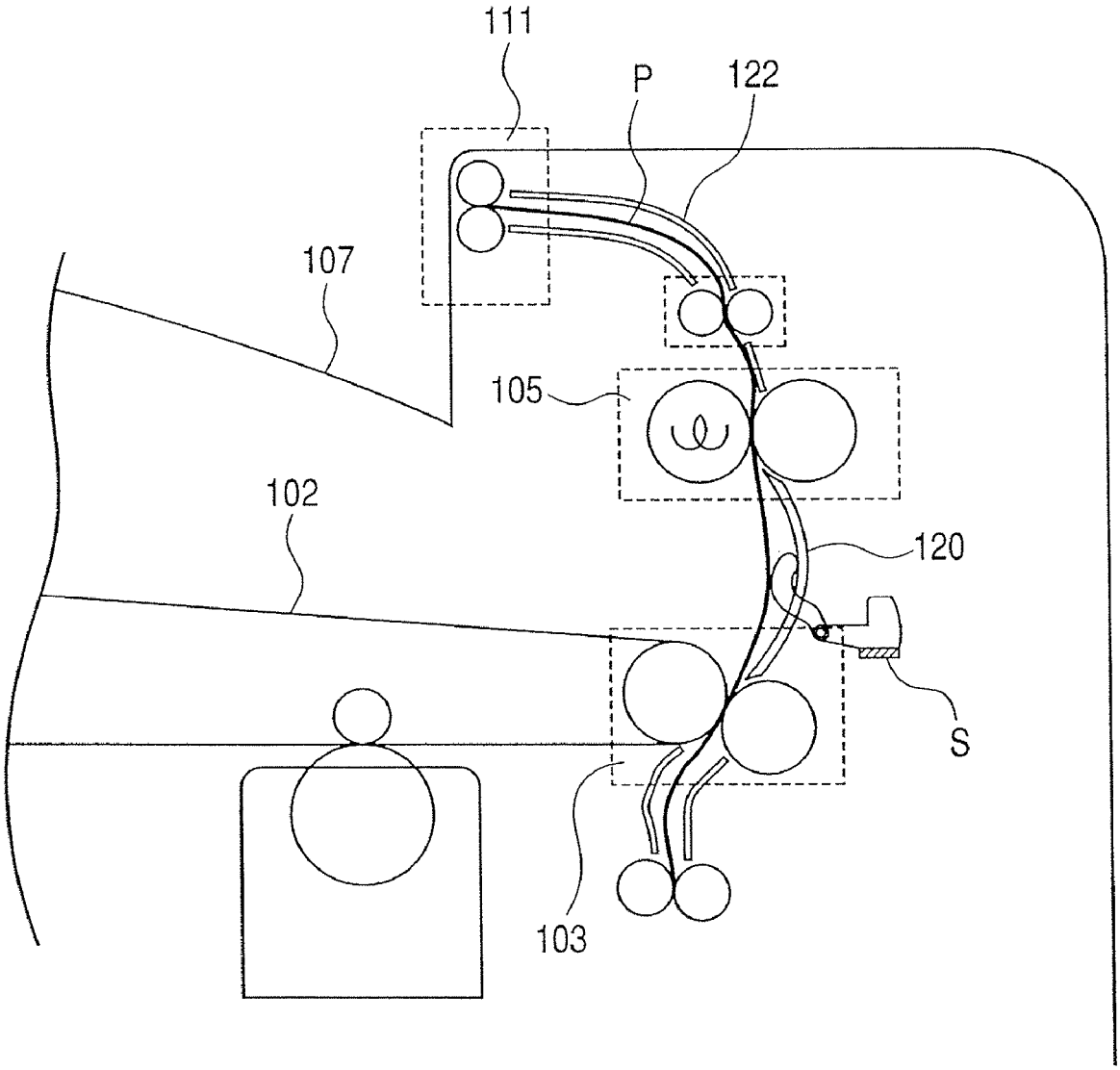
FIG. 10 PRIOR ART
FIG. 10 is a cross-sectional view of the essential portions of an image forming apparatus showing the conventional loop state between a transferring portion and a fixing portion.
Figure 11:
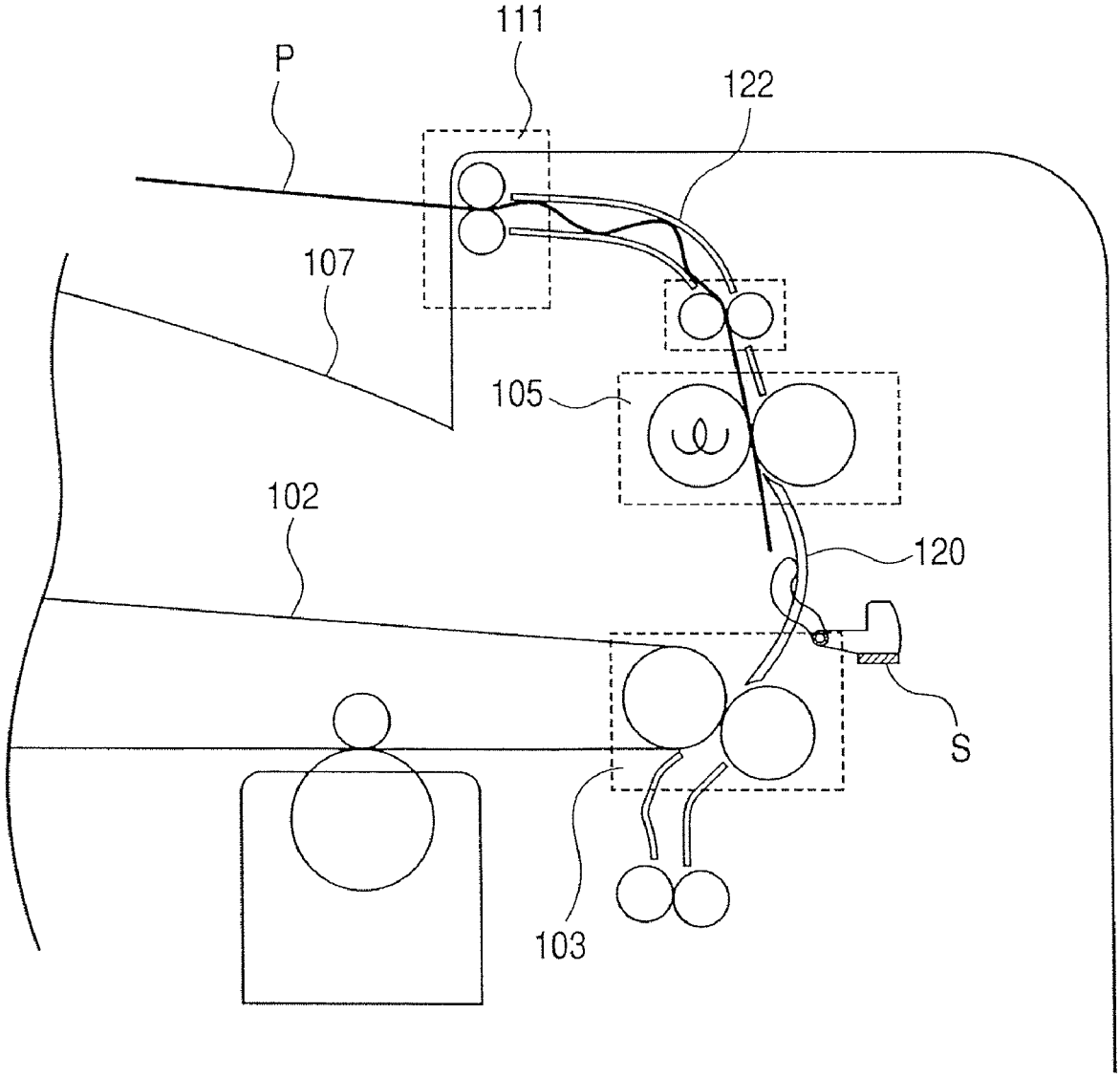
FIG. 11 PRIOR ART
FIG. 11 is a cross-sectional view of the essential portions of the image forming apparatus showing the conventional loop state between the fixing portion and a discharging portion.
Figure 12:
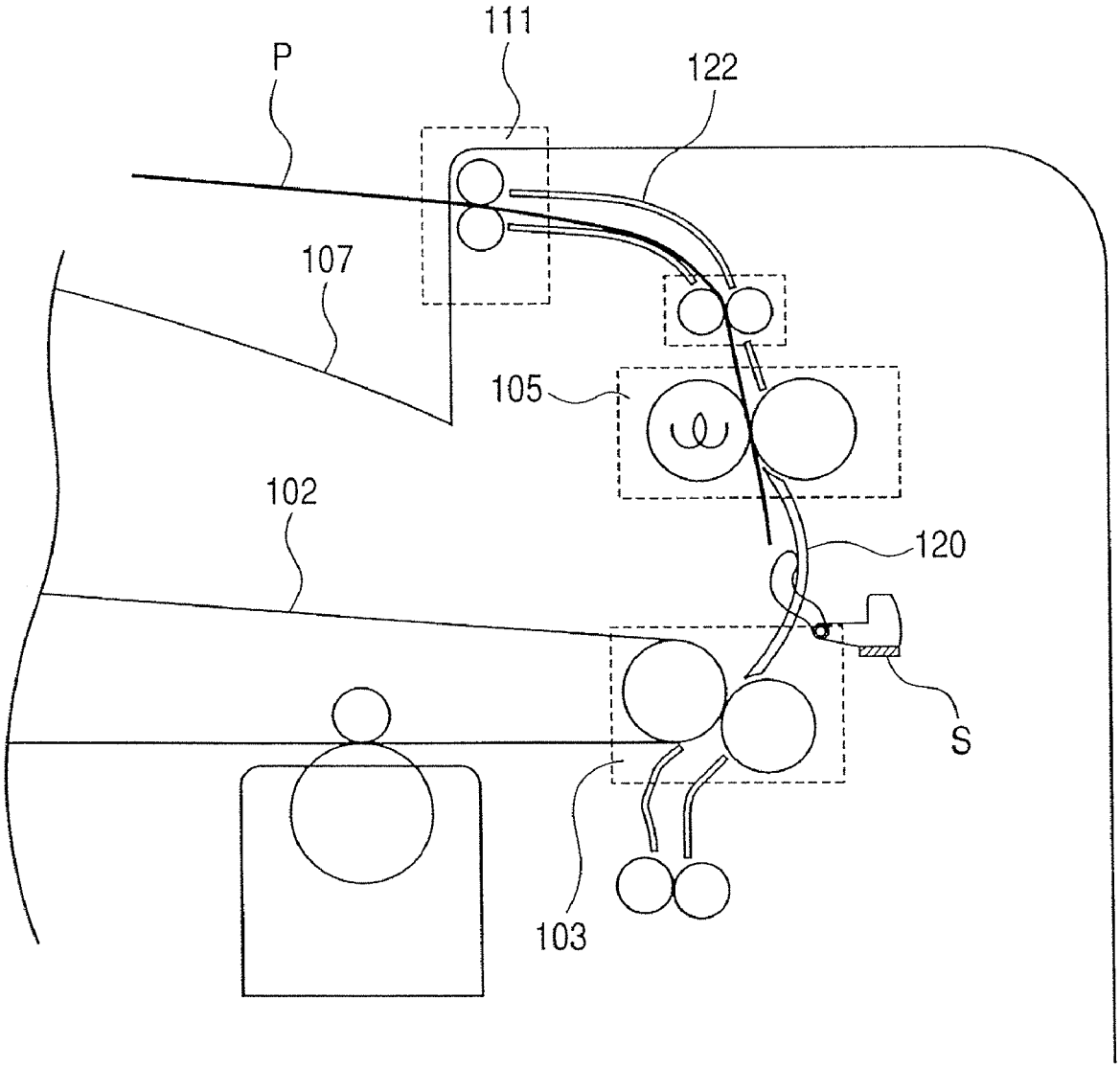
FIG. 12 PRIOR ART
FIG. 12 is a cross-sectional view of the essential portions of the image forming apparatus showing the conventional loop state between the fixing portion and the discharging portion.

An embodiment of the present invention will hereinafter be described with reference to the drawings. FIG. 1 is a cross-sectional view schematically showing the construction of the essential portions of an image forming apparatus according to an embodiment of the present invention. FIG. 2 is a timing chart showing the operation of the image forming apparatus according to the embodiment of the present invention. FIG. 3 is a block diagram of the image forming apparatus according to the embodiment of the present invention. FIG. 9 is a cross-sectional view showing the general construction of the image forming apparatus according to the embodiment of the present invention.

The construction of the entire image forming apparatus will first be schematically described, and then the drive control of a fixing driving portion and a discharging driving portion in the image forming apparatus will be described.

The color image forming apparatus 30 shown in FIG. 9 is provided with photosensitive drums "a" (yellow), "b" (magenta), "c" (cyan) and "d" (black) which are four image bearing members (electrophotographic photosensitive members) disposed parallel to one another for forming e.g. yellow, magenta, cyan and black toner images thereon, and an intermediate transfer belt 2 as an intermediate transfer member disposed above these photosensitive drums "a" to "d" in such a manner as to traverse them.

Around the respective photosensitive drums "a", "b", "c" and "d" driven by motors (not shown), there are disposed primary chargers, developing devices, etc., which are made into units as process cartridges 1*a*, 1*b*, 1*c* and 1*d* detachably mounted on an image forming apparatus main body 30.

Also, below the photosensitive drums "a" to "d", there is disposed an exposing apparatus 6 comprised of a polygon mirror or the like.

First, a laser beam by an image signal of a yellow component color is projected onto the photosensitive drum "a" in a first image forming portion via the polygon mirror or the like of the exposing apparatus 6, whereby an electrostatic latent image is formed on the photosensitive drum "a", and a yellow toner is supplied thereto from the developing device to thereby develop the electrostatic latent image, which is thus visualized as a yellow toner image.

When this toner image arrives at a primary transferring region in which the photosensitive drum "a" and the intermediate transfer belt 2 contact with each other, with the rotation of the photosensitive drum "a", the yellow toner image on the photosensitive drum "a" is transferred to the intermediate transfer belt 2 by a primary transferring bias applied to a transfer charging member 2*a* (primary transfer).

When the region of the intermediate transfer belt 2 which bears the yellow toner image thereon is moved to the next image forming portion, a magenta toner image is formed on the photosensitive drum "b" by this time by a process similar to that in the previous image forming portion, and the magenta toner image is superimposed on the yellow toner image on the intermediate transfer belt 2 and transferred in a primary transferring region wherein the photosensitive drum "b" and the intermediate transfer belt 2 contact with each other. Likewise, as the intermediate transfer belt 2 is moved, a cyan toner image and a black toner image are successively superimposed on the yellow toner image and the magenta toner image and transferred in the respective primary transferring regions of the subsequent image forming portions.

On the other hand, recording materials P are contained in a cassette 4. The recording materials P are fed out of the cassette 4 one by one by a pickup roller 8, and the fed recording material P is timed with the image formation by registration rollers 9, and thereafter arrives at a secondary transferring region, where the four color toner images on the intermediate transfer belt 2 are collectively transferred onto the recording material P by a secondary transferring bias applied to a pair of secondary transfer rollers 3 as transferring means (secondary transfer).

The recording material P onto which the four color toner images have been transferred is guided by a conveying guide 20 and is conveyed to a pair of fixing rollers 5 as fixing means disposed above the pair of transfer rollers 3, and receives heat and pressure there, whereby the four color toner images are fixed. Thereby, the toners of the respective colors are fused and mixed together and are fixed as a full-color printed image on the recording material P. Thereafter, the recording material P on which the image has been fixed is guided by conveying guides 21 and 22, and is discharged onto a discharging tray 7 by a pair of discharging rollers 11 as discharging means provided downstream of the pair of fixing rollers 5.

Description will now be made of the drive control of the fixing driving portion and the discharging driving portion in the image forming apparatus. The image forming apparatus according to the present embodiment, as shown in FIG. 1, has a loop detecting sensor S as loop detecting means for detecting the loop state of the recording material between the pair of transfer rollers 3 and the pair of fixing rollers 5, a fixing motor M as a fixing driving portion for rotatively driving the pair of fixing rollers 5 and capable of changing over the recording material conveying speed of the pair of fixing rollers 5, a discharging motor N as a discharging driving portion for rotatively driving the pair of discharging rollers 11 independently of the fixing motor M, and capable of changing over the recording material conveying speed of the pair of discharging rollers 11, and a control board 51 as controlling means for controlling the driving of the fixing motor M and the discharging motor N.

The control board 51, as shown in FIG. 3, has a CPU 17, a timer 14 and a memory 50. The control board 51 changes over the recording material conveying speed of the pair of fixing rollers 5 on the basis of the detection by the loop detecting sensor S and controls the loop of the recording material P so as to be maintained within a predetermined range.

Also, the control board 51 controls the recording material conveying speed of the pair of discharging rollers 11 so as to become equal to the recording material conveying speed of the pair of fixing rollers 5 after the recording material P has passed the pair of transfer rollers 3. Specifically, the control board 51 has loop detecting masking Q as mask means capable of rendering the loop detecting sensor S into a non-operative state for a predetermined time after the recording material has passed the pair of transfer rollers 3, and controls the driving of the discharging motor N so that when the loop detecting sensor S is in the non-operative state by the loop detecting masking Q, the recording material conveying speed of the pair of discharging rollers 11 may become equal to the recording material conveying speed of the pair of fixing rollers 5.

The dimensional information (the length in the conveying direction, etc.) of the recording material P, as shown in FIG. 3, is preset in the memory 50 in the control board 51, and is set by information from user setting information 15 before image formation.

The recording materials P are fed out of the cassette 4 one by one by the pickup roller 8, and the fed recording material is timed with the image formation by the registration rollers 9 being at a halt.

When as shown in FIGS. 2 and 3, the registration clutch 13 of the driving system of the registration rollers 9 is switched on, the drive is transmitted to the registration rollers 9, and the recording material P is conveyed toward the pair of secondary transfer rollers 3 which provide the secondary transferring region.

Also, simultaneously with the switching-on of the registration clutch 13, the counting by the timer 14 in the control board 51 is started.

When the recording material P arrives at the secondary transferring region, the four color toner images on the intermediate transfer belt 2 are collectively transferred onto the recording material P by a secondary transferring bias applied to the pair of secondary transfer rollers 3 (secondary transfer).

Figure 4:
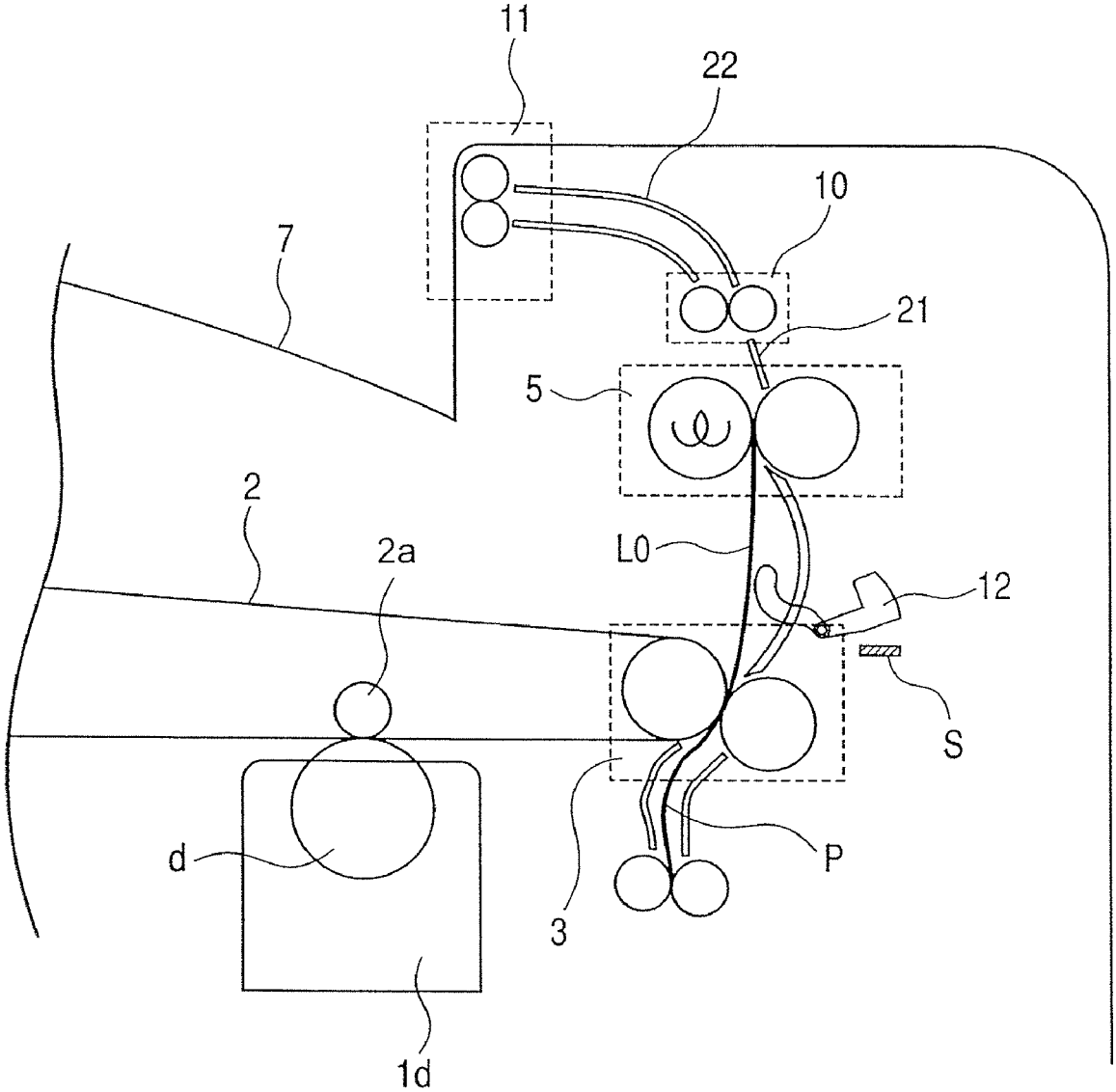
FIG. 4 is a fragmentary cross-sectional view showing the loop state of a recording material between transferring rollers and fixing rollers of the image forming apparatus according to the embodiment of the present invention on the inrush of the recording material into the fixing rollers.

The recording material P onto which the four color toner images have been transferred is guided by the conveying guide 20 and rushes into the nip part between the pair of fixing rollers 5, as shown in FIG. 4.

The pair of fixing rollers 5, as previously described, is driven by the fixing motor (fixing driving portion) M which is a driving source independent of the driving sources for the photosensitive drums, the developing devices, the intermediate transfer belt, the pair of discharging rollers, etc. Also, the fixing motor M is a stepping motor, and is designed such that the rotating speed thereof can be changed over on the basis of the pulse signal of a driver in the control board 51.

As shown in FIG. 2, with the timing at which the leading edge portion of the recording material P rushes into between the pair of fixing rollers 5 as the first starting time of the loop detecting masking Q, the time Ts from the starting of the timer 14 is preset in the memory 50. That is, the loop detecting masking Q is turned on and the signal reading by the loop detecting sensor S is started.

Figure 5:
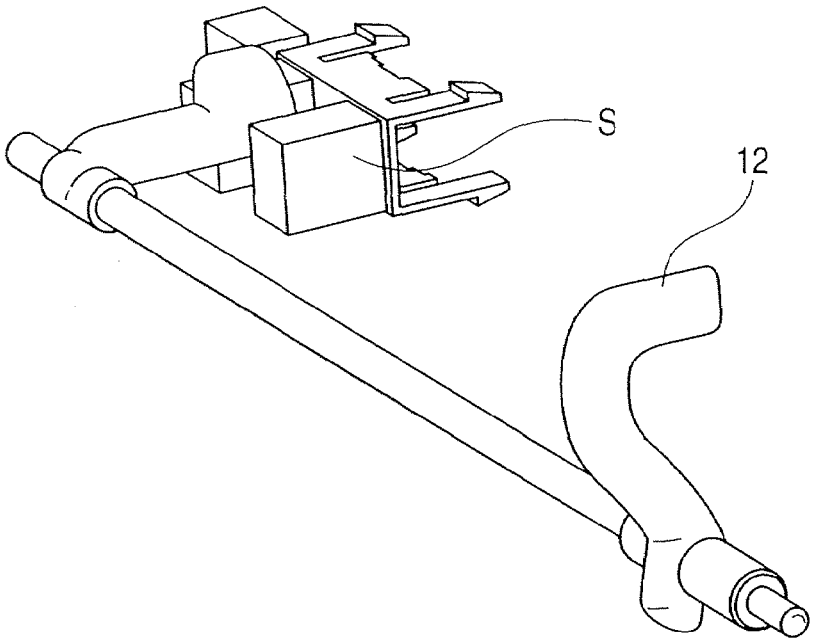
FIG. 5 is a perspective view showing an example of loop detecting means according to an embodiment of the present invention.

Here, as shown in FIG. 5, the loop detecting sensor S is a photo-interrupter, and detects the loop amount L1 of the recording material P between the pair of secondary transfer rollers 3 and the pair of fixing rollers 5 through a loop detecting flag 12.

Figure 6:
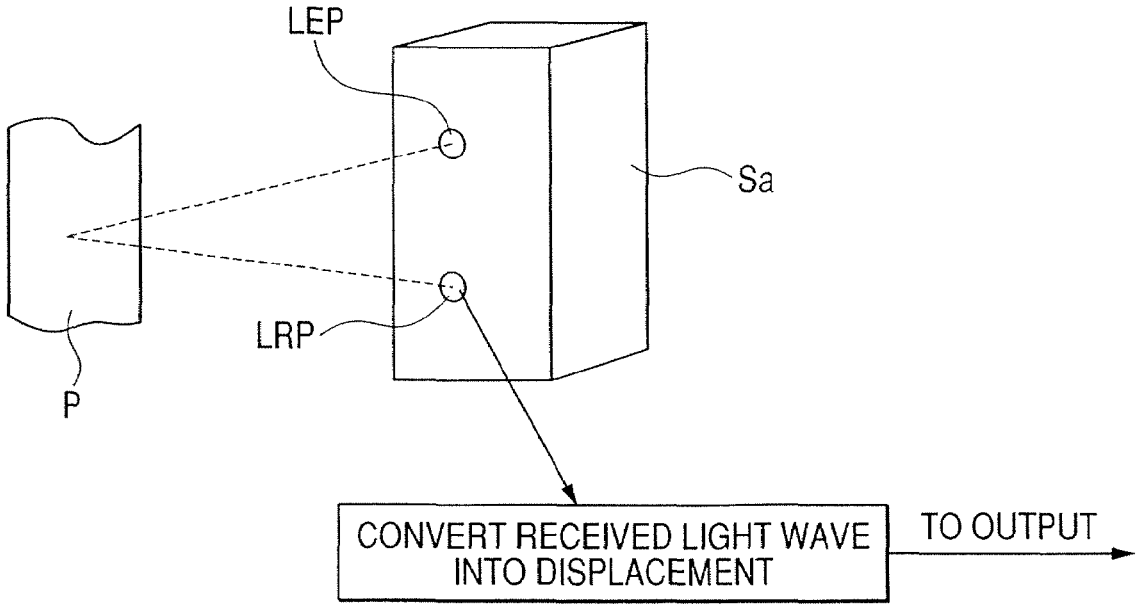
FIG. 6 is a typical view showing another example of the loop detecting means according to the embodiment of the present invention.

The loop detecting means is not restricted to the loop detecting sensor S shown in FIG. 5, but as shown for example, in FIG. 6, an optical type displacement sensor Sa of a non-contact type may be used to detect the loop of the recording material P. The displacement sensor Sa comprises a light emitting portion LEP and a light receiving portion LRP, and receives light from the light emitting portion LEP reflected by the recording material P, by the light receiving portion LRP. The received light wave is converted into displacement.

When the recording material P rushes into the nip part between the pair of fixing rollers 5 in the aforedescribed manner, the loop amount L1 of the recording material P between the pair of transfer rollers 3 and the pair of fixing rollers 5 gradually becomes great because the recording material conveying speed Vf of the pair of fixing rollers 5 is preset to a speed Vf1 (the rotating speed M1 of the fixing motor M) lower than the recording material conveying speed Vt of the pair of secondary transfer rollers 3.

Figure 7:
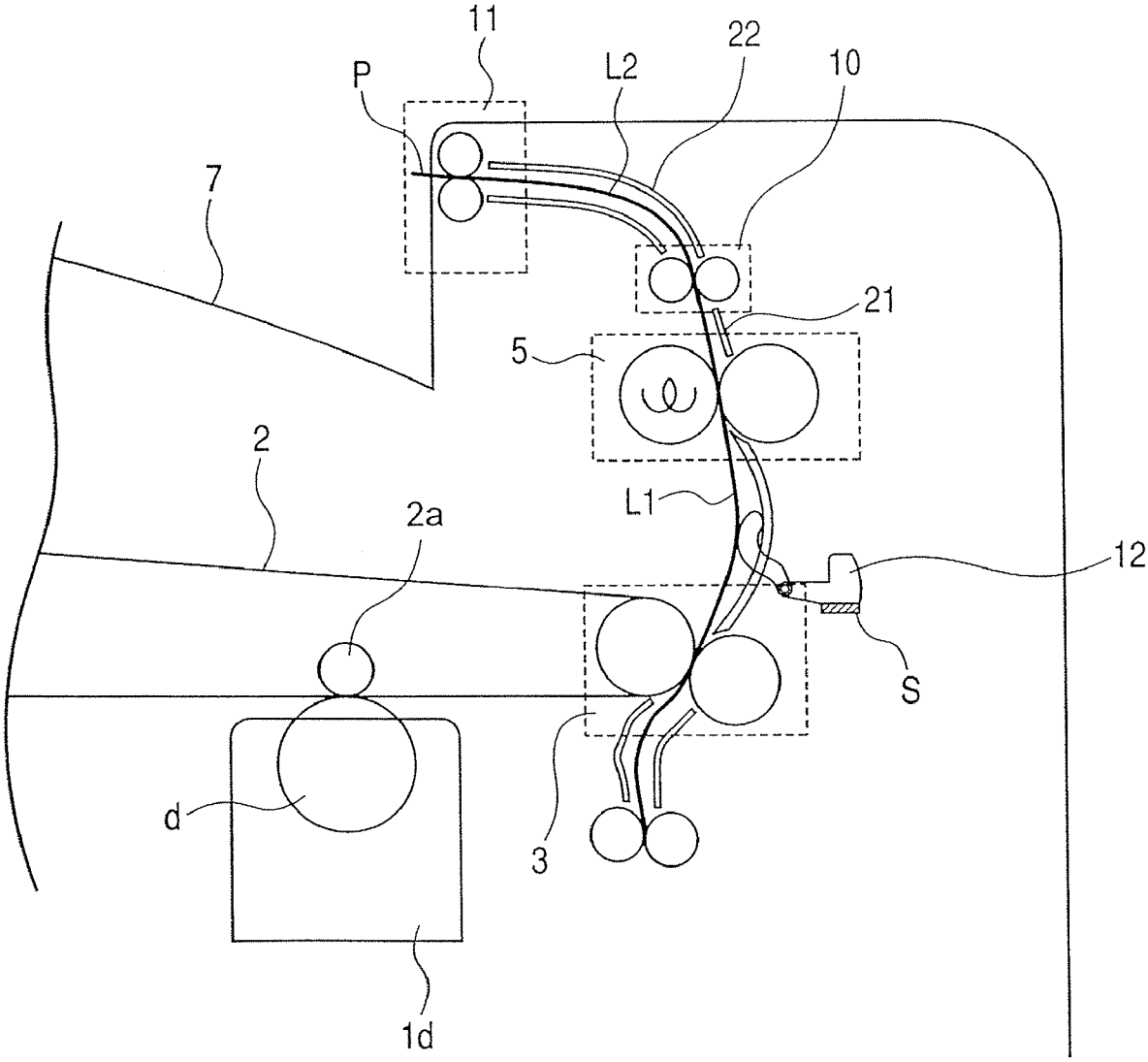
FIG. 7 is a fragmentary cross-sectional view showing the loop state of the recording material during loop detection in the image forming apparatus according to the embodiment of the present invention.

When as shown in FIG. 2, the loop amount L1 of the recording material P between the pair of secondary transfer rollers 3 and the pair of fixing rollers 5 becomes La, the loop detecting flag 12 is pushed and pivotally moved by the looped recording material P, and by this loop detecting flag 12, the loop detecting sensor S is turned from its OFF state to its ON state shown in FIG. 7.

When this loop detecting sensor S assumes its ON state, as shown in FIG. 2, the fixing motor M is changed over so that after a predetermined delay time Ta, the recording material conveying speed Vf of the pair of fixing rollers 5 may become a speed Vfh (the rotating speed Mh of the fixing motor M) higher than the recording material conveying speed of the pair of secondary transfer rollers 3. Thereby, the loop amount L1 of the recording material P between the pair of transfer rollers 3 and the pair of fixing rollers 5 gradually becomes smaller.

When the magnitude of the loop L1 of the recording material P gradually becomes smaller and the loop detecting sensor S is changed over from its ON state to its OFF state, as shown in FIG. 2, the fixing motor M is again changed over so that after a predetermined delay time Tb, the recording material conveying speed Vf of the pair of fixing rollers 5 may become a speed Vf1 (the rotating speed M1 of the fixing motor M) lower than the recording material conveying speed of the pair of secondary transfer rollers 3. Thereby, the loop amount L1 of the recording material P between the pair of transfer rollers 3 and the pair of fixing rollers 5 gradually becomes greater again.

By the above-described process being repeated, the loop of the recording material P can be maintained within a predetermined range, that is, between the pair of secondary transfer rollers 3 and the pair of fixing rollers 5, the loop state (the loop amount L1) of the recording material P can be substantially kept at a loop amount La shown in FIG. 2, where L0 represents the zero state of the loop.

In the meantime, the pair of first discharging rollers 10 and the pair of second discharging rollers 11 which are discharging means are rotatively driven by the discharging motor N to thereby convey the recording material P on which the image has been heated and fixed by the pair of fixing rollers 5 to the discharging tray 7. Also, the discharging motor N, like the fixing motor M, is a stepping motor, and is designed such that the rotating speed thereof can be changed over on the basis of the pulse signal of the driver in the control board 51.

Here, the pair of first discharging rollers 10 performs a curling function, and are set so as to always assume a recording material conveying speed higher than the recording material conveying speed Vf of the pair of fixing rollers 5, and keep the recording material P in its pulled state so that the recording material P may not be curled as far as possible.

Although the pair of first discharging rollers 10 are set to a conveying speed higher than that of the pair of fixing rollers 5, the pair of first discharging rollers 10 are much lower in conveying force than the pair of fixing rollers 5 and are therefore in a slip conveying state. Therefore, they do not adversely affect the fixing of the unfixed image by the pair of fixing rollers 5.

On the other hand, the pair of second discharging rollers 11 perform chiefly the function of discharging and conveying the recording material to the discharging tray 7, and are set to a recording material conveying speed (the rotating speed Nh of the discharging motor N shown in FIG. 2) equal to that of the pair of transfer rollers 3 during the time when the loop detecting sensor S is detecting the loop between the pair of secondary transfer rollers 3 and the pair of fixing rollers 5.

Accordingly, during the time when the loop detecting sensor S is detecting the loop between the pair of secondary transfer rollers 3 and the pair of fixing rollers 5, the loop of the recording material can be maintained within the predetermined range by an increase or decrease in the aforedescribed conveying speed of the pair of fixing rollers 5, that is, the loop state (the loop amount L2) of the recording material P can also be substantially kept at the loop amount Lb shown in FIG. 2 between the pair of fixing rollers 5 and the pair of second discharging rollers 11.

Figure 8:
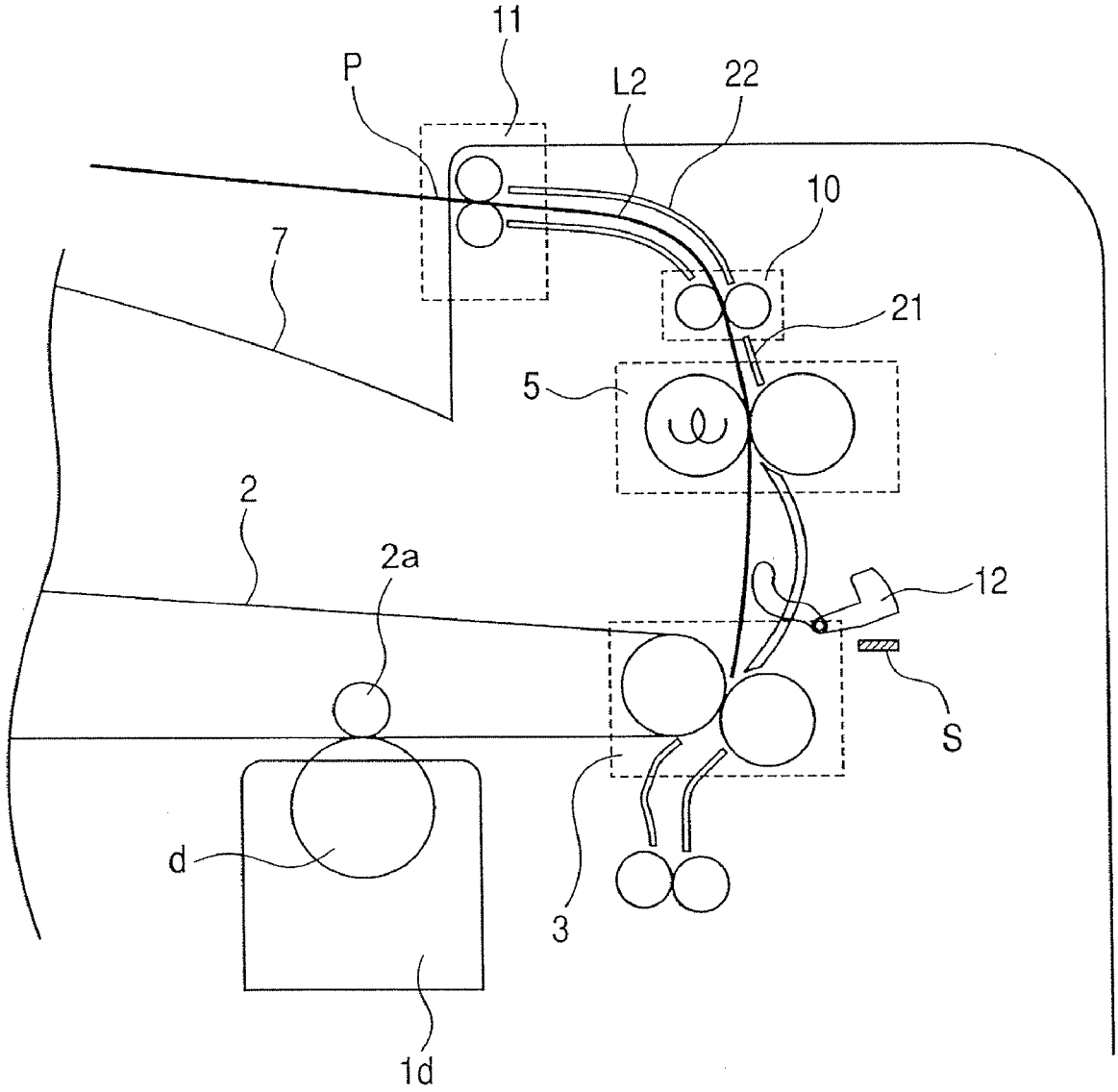
FIG. 8 is a fragmentary cross-sectional view showing a state in which the trailing edge of the recording material has left a pair of transfer rollers in the image forming apparatus according to the embodiment of the present invention.

When as shown in FIG. 8, the trailing edge of the recording material P soon leaves the pair of secondary transfer rollers 3, the loop of the recording material P is released and therefore, the loop detecting sensor S becomes incapable of detecting the loop of the recording material P.

Accordingly, on the basis of the dimensional information preset in the memory 50 as previously described, the timing at which the trailing edge of the recording material P leaves the pair of secondary transfer rollers 3 is set to a value Td counted from the timer 14, and when as shown in FIG. 2, the count by the timer 14 reaches the value Td, the loop detecting masking Q becomes OFF, and the signal reading by the loop detecting sensor S is completed. That is, the loop detecting sensor S becomes non-operative.

At the same time, the fixing motor M is changed over to the low speed side rotating speed M1 in preparation for the subsequent recording material P rushing into between the pair of fixing rollers 5.

At the same time, the discharging motor N independent of the fixing motor M is also changed over to a rotating speed N1 so that the conveying speed of the pair of second discharging rollers 11 may become a conveying speed equal to the recording material conveying speed of the pair of fixing rollers 5 driven at the low speed side rotating speed M1 of the fixing motor M so that the loop state (the loop amount L2) of the recording material between the pair of fixing rollers 5 and the pair of second discharging rollers 11 may not become excessively great or excessively small.

The timing at which the loop detecting sensor S becomes non-operative by the loop detecting masking Q can be set during the time from after the preceding recording material P has been nip-conveyed to the pair of second discharging rollers 11 until the succeeding recording material P is nip-conveyed to the pair of fixing rollers 5.

Then, the trailing edge of the recording material P leaves the pair of fixing rollers 5 and the pair of first discharging rollers 10 in succession, and finally the recording material P is discharged onto the discharging tray 7 by the pair of second discharging rollers 11.

As described above, in the image forming apparatus according to the present embodiment, not only the conveyed state of the recording material P between the pair of transfer rollers 3 and the pair of fixing rollers 5 is stabilized, but also a faulty image caused by the conveyed state of the recording material after the trailing edge of the recording material has left the pair of transfer rollers 3, i.e., the loop state of the recording material between the pair of fixing rollers 5 and the pair of discharging rollers 11, and faulty conveyance due to excessive curl can be prevented.

Also, because of the presence of the mask means (loop detecting masking Q) of the loop detecting sensor S, the conveyed state of the recording material not only during the time when a loop is being made between the pair of transfer rollers 3 and the pair of fixing rollers 5, but also after the recording material has left the pair of transfer rollers 3 can be accurately controlled, and the conveyance of the recording material can be stabilized even for a system in which the distance between the respective pairs of rollers is short.

While in the present embodiment, the fixing motor M is set so as to be changed over to the low speed side rotating speed M1 when the loop detecting sensor S becomes non-operative, the present invention is not restricted thereto. Design may also be made such that the recording material conveying speed of the pair of fixing rollers by the fixing motor M and the recording material conveying speed of the pair of discharging rollers by the discharging motor N are changed over so as to become substantially equal to each other. For example, when it is desired to discharge the recording material at a high speed, the fixing motor M is set to the high speed side rotating speed Mh, and the discharging motor N is set to the high speed side rotating speed Nh. In this case, the fixing motor M is changed over to the low speed side rotating speed M1 before the succeeding recording material P rushes into between the pair of fixing rollers 5.

Also, while in the aforedescribed embodiment, there is shown an image forming apparatus using four image forming portions for color image formation, this number of the image forming portions is not restrictive, but can be suitably set as required.

Also, while in the aforedescribed embodiment, a printer has been shown as the image forming apparatus, the present invention is not restricted thereto, but the image forming apparatus may be other image forming apparatus such as, for example, a copying machine or a facsimile apparatus, or other image forming apparatus such as a compound machine having a combination of these functions, or an image forming apparatus which uses a recording material bearing member and in which toner images of respective colors are successively superimposed and transferred onto a recording material borne on the recording material bearing member, or an image forming apparatus which uses not the aforedescribed belt-shaped image bearing member, but a drum-shaped image bearing member as an intermediate transfer member, and in which toner images of respective colors are successively superimposed and transferred onto the intermediate transfer member, and the toner images borne on the intermediate transfer member are collectively transferred to a recording material, and the present invention can be applied to such image forming apparatus to thereby obtain a similar effect.

This application claims priority from Japanese Patent Application No. 2004-258854 filed Sep. 6, 2004, which is hereby incorporated by reference herein.

What is claimed is:

1. An image forming apparatus comprising:

transferring device which transfers an unfixed image borne on an image bearing member to a recording material;

a fixing device which fixes the transferred unfixed image on the recording material, and the fixing device is changeable in a recording material conveying speed thereof, wherein the recording material conveying speed of said fixing device has a high speed mode higher than the recording material conveying speed of said transferring device and low speed mode lower than the recording material conveying speed of said transferring device, and the high speed mode and low speed mode are changed over based on an amount of a loop generated between said transferring device and said fixing device;

a discharging device changeable in a recording material conveying speed thereof and discharges the recording material on which the image has been fixed by said fixing device; and a controlling device which controls the recording material conveying speed of said discharging device so as to be changed over accompany a changing of the recording material conveying speed of said fixing device at a timing when the recording material has passed said transferring device.

2. An image forming apparatus according to claim 1, wherein the recording material conveying speed of said fixing device is set to the high speed mode or low speed mode after the recording material has passed said transferring device, and the recording material conveying speed of said discharging device is changed accompany set the mode.

3. An image forming apparatus according to claim 2, further comprising a loop detecting device which detects a loop state of the recording material between said transferring device and said fixing device, the recording material conveying speed of said fixing device is set to the high speed mode or low speed mode based on a detection of the loop detecting device.

4. An image forming apparatus according to claim 1, wherein said fixing device is disposed above said transferring device, and the recording material is conveyed from below to above.

* * * * *